US006871370B2

(12) United States Patent
Choi et al.

(10) Patent No.: US 6,871,370 B2
(45) Date of Patent: Mar. 29, 2005

(54) METHOD FOR CONTROLLING WASHING IN WASHING MACHINE

(75) Inventors: Byung Keol Choi, Kyonggi-do (KR); Dae Yun Park, Kyonggi-do (KR)

(73) Assignee: LG Electronics, Inc., Seoul (KR)

( * ) Notice: Subject to any disclaimer, the term of this patent is extended or adjusted under 35 U.S.C. 154(b) by 398 days.

(21) Appl. No.: 10/157,080

(22) Filed: May 30, 2002

(65) Prior Publication Data

US 2003/0097719 A1 May 29, 2003

(30) Foreign Application Priority Data

Nov. 23, 2001 (KR) ..... 2001-73343

(51) Int. Cl.[7] ..... D06F 33/02

(52) U.S. Cl. ..... 8/159; 68/12.05; 68/12.21; 68/207

(58) Field of Search ..... 8/158, 159; 68/133, 68/132, 207, 12.04, 12.05, 12.19, 12.21

(56) References Cited

U.S. PATENT DOCUMENTS

| | | | | | |
|---|---|---|---|---|---|
| 2,526,344 | A | * | 10/1950 | Geldhof et al. | 68/148 |
| 2,703,974 | A | * | 3/1955 | Clark | 68/23.3 |
| 3,304,751 | A | * | 2/1967 | Schwing | 68/23.5 |
| 3,722,902 | A | * | 3/1973 | Marker | 280/628 |
| 3,875,770 | A | * | 4/1975 | Brimer et al. | 68/23.7 |
| 4,335,592 | A | * | 6/1982 | Torita | 68/12.18 |
| 4,809,524 | A | * | 3/1989 | Sickert et al. | 68/148 |
| 5,167,722 | A | * | 12/1992 | Pastryk et al. | 134/33 |
| 5,208,931 | A | * | 5/1993 | Williams et al. | 8/159 |
| 5,241,781 | A | * | 9/1993 | Malczyk | 47/17 |
| 5,606,877 | A | * | 3/1997 | Hashimoto | 68/12.04 |
| 5,617,747 | A | * | 4/1997 | Kim | 68/53 |
| 5,661,989 | A | * | 9/1997 | Jeon et al. | 68/18 F |
| 5,727,402 | A | * | 3/1998 | Wada | 68/23.5 |
| 5,743,115 | A | * | 4/1998 | Hashimoto | 68/12.12 |
| 5,878,456 | A | * | 3/1999 | Lee | 8/159 |
| 5,878,601 | A | * | 3/1999 | Won et al. | 68/23.5 |
| 6,082,152 | A | * | 7/2000 | Im | 68/23.7 |
| 6,145,350 | A | * | 11/2000 | Hwang | 68/18 F |
| 6,247,339 | B1 | * | 6/2001 | Kenjo et al. | 68/12.04 |
| 6,668,410 | B2 | * | 12/2003 | Lyu et al. | 8/158 |

FOREIGN PATENT DOCUMENTS

| | | | |
|---|---|---|---|
| CN | 1222602 A | | 7/1999 |
| JP | 52-97269 | * | 8/1977 |

* cited by examiner

*Primary Examiner*—Frankie L. Stinson
(74) *Attorney, Agent, or Firm*—Birch, Stewart, Kolasch & Birch, LLP

(57) ABSTRACT

Method for controlling washing in a washing machine including the steps of (a) sensing an amount of laundry in an inner tub and determining a washing water level proper to the amount of laundry, (b) introducing washing water into the inner tub according to the washing water level, and (c) rotating the inner tub in one direction so that the washing water rises along a space between the inner tub and an outer tub and is sprayed into the inner tub again by a centrifugal force during the step (b), whereby carrying out a pre-washing during water supply even if no separate water re-circulating device is provided.

14 Claims, 7 Drawing Sheets

METHOD FOR CONTROLLING WASHING IN WASHING MACHINE

This application claims the benefit of the Korean Application No. P2001-73343 filed on Nov. 23, 2001, which is hereby incorporated by reference.

BACKGROUND OF THE INVENTION

1. Field of the Invention

The present invention relates to a washing machine, and more particularly, to a method for controlling washing in a washing machine.

2. Background of the Related Art

In general, the washing machine removes various contaminants from clothes, beddings, and the like by softening action of detergent and friction of water circulation.

Referring to FIG. 1, a related art washing machine is provided with a case 1, an outer tub 2 elastically suspended from an inside part of the case by a suspension for storage of washing water, an inner tub 3 rotatably fitted in the outer tub for holding laundry, and a driving part 4 fitted to an underside of the outer tub for rotating the inner tub.

The washing machine has a problem in that the washing machine is only supplied with washing water from an external water supply source, but can not carry out pre-washing during water supply, thereby wasting a water supply time period. Consequently, for using the water supply time period efficiently, a washing machine is suggested, which can carry out pre-washing during a time period washing water is supplied from the water supply source.

Such a washing machine is further provided with a re-circulating device having a re-circulating line 5 with one end connected to a lower end of the outer tub 2 for re-circulating the washing water between the outer tub 2 and the inner tub 3 to the inner tub, a pump 6 on the re-circulating line for forced circulation of the washing water, and a spray nozzle 7 at an outlet of the re-circulating line for spraying the washing water into the inner tub.

However, the washing machine having the re-circulating device has the following problems.

First, while the washing machine can improve a washing performance by smooth dissolving of detergent during water supply, the washing machine has a complicated structure and a high cost due to the re-circulating device.

Second, the washing water re-circulation by the re-circulating device impedes proper operation of a pneumatic level sensor, to require stopping water supply for a water level sensing, that delays the water supply time period.

SUMMARY OF THE INVENTION

Accordingly, the present invention is directed to a method for controlling washing in a washing machine that substantially obviates one or more of the problems due to limitations and disadvantages of the related art.

An object of the present invention is to provide a method for controlling washing in a washing machine, in which a pre-washing is carried out not by a re-circulating device during water supply for improving a washing performance and reducing a washing time period.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for controlling washing in a washing machine includes the steps of (a) sensing an amount of laundry in an inner tub and determining a washing water level proper to the amount of laundry, (b) introducing washing water into the inner tub according to the washing water level, and (c) rotating the inner tub in one direction so that the washing water rises along a space between the inner tub and an outer tub and is sprayed into the inner tub again by a centrifugal force during the step (b).

The step (c) includes the steps of (c1) accelerating the inner tub to a preset first RPM, while the washing water is supplied to a preset first water level, (c2) calculating the present water pressure by using a time period the water is supplied to the first water level, (c3) when the water level of the inner tub is reached to the first water level, increasing a rotation speed of the inner tub up to a preset second RPM until the water level of the inner tub is reached to a preset second water level, for spraying the washing water into the inner tub by the centrifugal force, and (c4) when the water level in the inner tub is reached to the second water level, reducing the rotation speed of the inner tub for preventing the washing water from being splashed to a part outside of the outer tub.

In another aspect of the present invention, there is provided a method for controlling washing in a washing machine, including the steps of (a) sensing an amount of laundry in an inner tub and determining a washing water level proper to the amount of laundry, (b) introducing washing water into the inner tub according to the washing water level, (c) accelerating the inner tub to a preset first RPM, while the washing water is supplied to a preset first water level, (d) calculating the present water pressure by using a time period the water is supplied to the first water level, (e) when the water level of the inner tub is reached to the first water level, increasing a rotation speed of the inner tub up to a preset second RPM until the water level of the inner tub is reached to a preset second water level, for spraying the washing water into the inner tub by the centrifugal force, (f) when the water level in the inner tub is reached to the second water level, stopping rotation of the inner tub to settle the washing water, (g) when the water level of the inner tub is reached to a third water level, increasing the rotation speed of the inner tub up to a preset third RPM until the water level of the inner tub is reached to a preset fourth water level, for spraying the washing water into the inner tub by the centrifugal force, and (h) when the water level in the inner tub is reached to the fourth water level, stopping rotation of the inner tub for preventing the washing water from splashing to outside of the outer tub.

Accordingly, the present invention provides advantages of improving a washing performance and shortening a washing time period by dissolving more detergent quickly during water supply. Moreover, the present invention can solve the problem of washing water contamination by detergent, not dissolved, but remained in the washing water in the washing process.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In explaining embodiments of the present invention, the same parts will be given the same names and symbols, and iterative explanation of which will be omitted.

Figure 1:
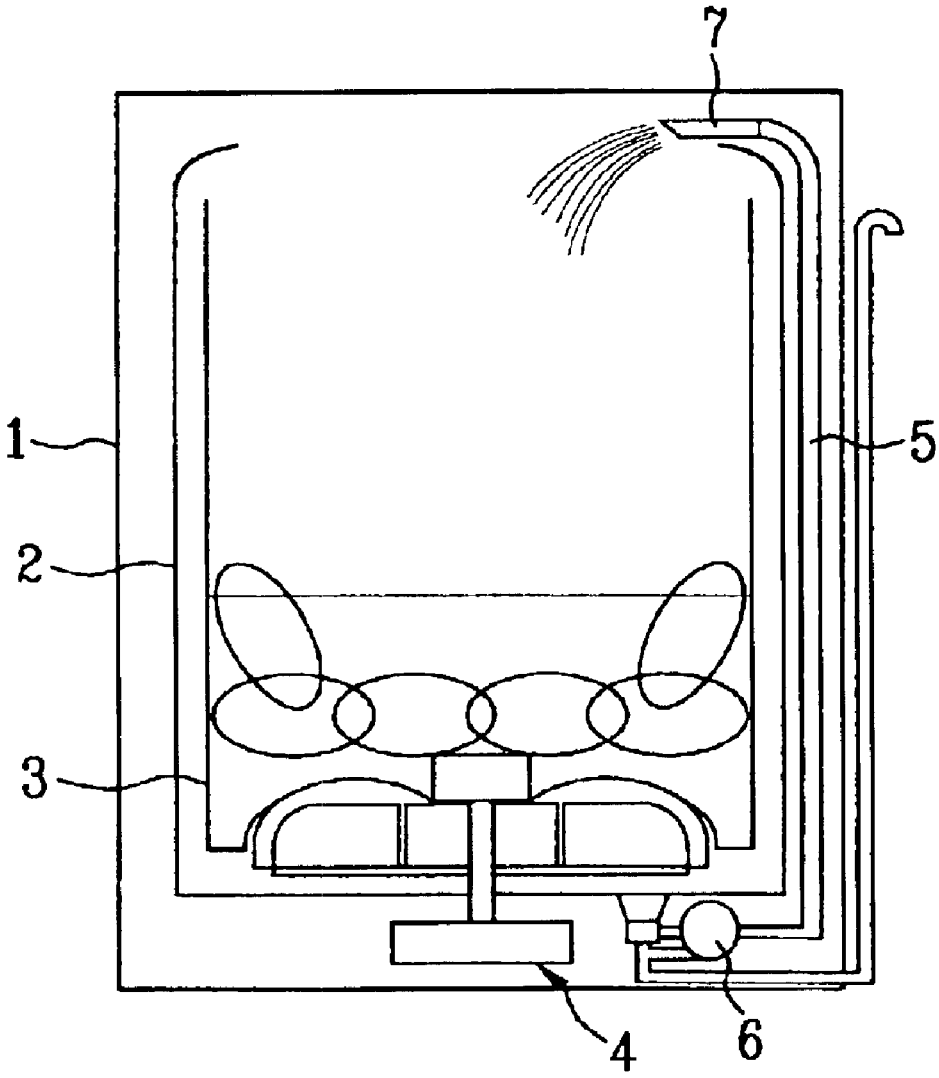
FIG.1 Prior Art
FIG. 1 illustrates a related art washing machine during water supply, schematically.
Figure 2:
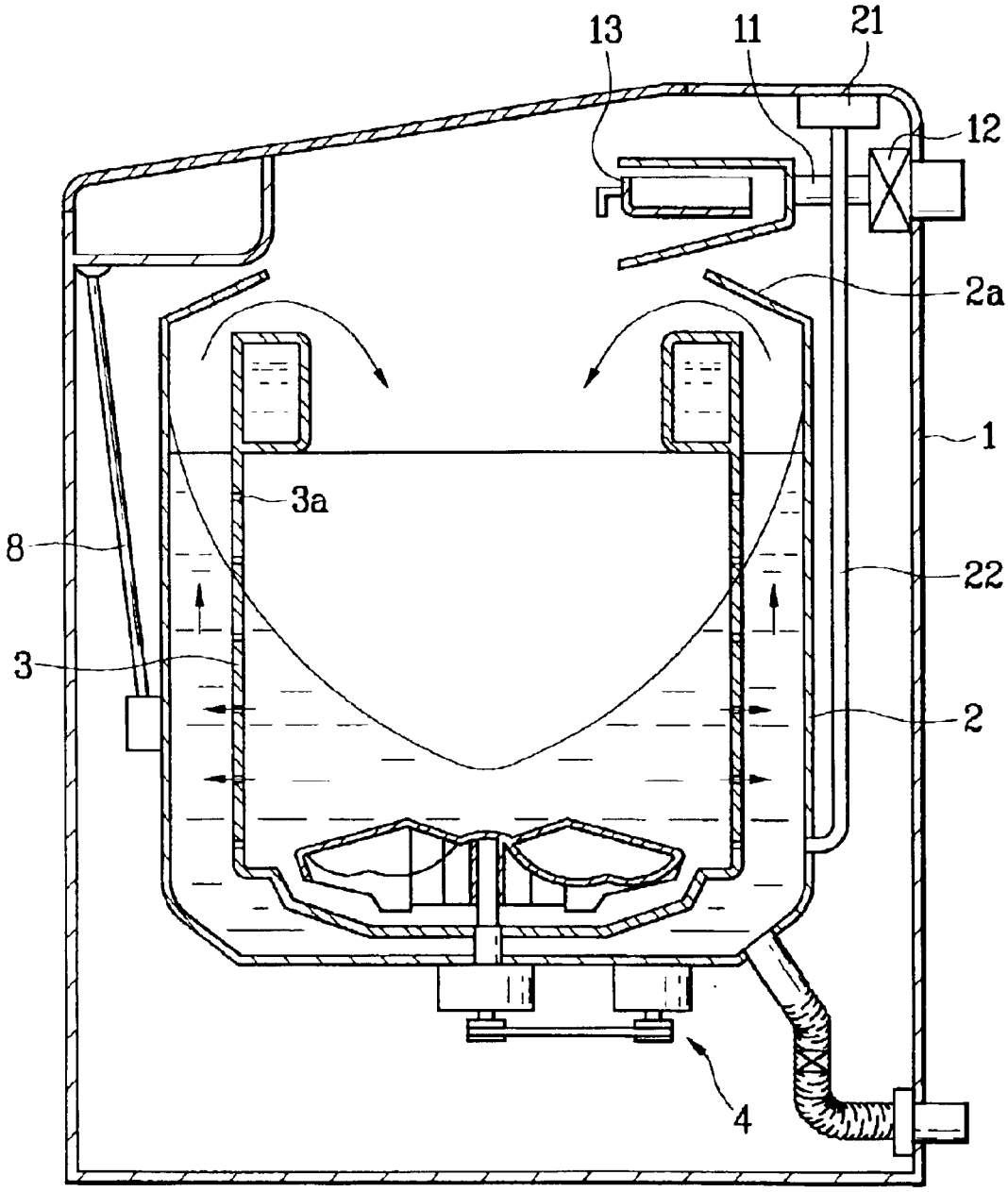
FIG. 2 illustrates a washing machine during water supply in accordance with a preferred embodiment of the present invention, schematically.

FIG. 2 illustrates a washing machine a method for controlling washing of the present invention is applicable thereto. The washing machine in FIG. 2 is illustrative only for convenience of explanation, of which system is as follows.

The washing machine of the present invention includes a case 1, an outer tub 2 elastically suspended from an inside part of the case by a suspension 8 for storage of washing water, an inner tub 3 rotatably fitted in the outer tub for holding laundry, and a driving part 4 fitted to an underside of the outer tub for rotating the inner tub. There are a plurality of through holes 3*a* in a wall surface of the inner tub 3 for free flow of the washing water between the inner tub 3 and the outer tub 2.

There is a water supply line 11 above the outer tub 2 for guiding washing water from an external water supply source to the inner tub 3. There is a water supply valve 12 on the water supply line open/closed in response to a signal from a controlling part, and a detergent case 13 at an end of the water supply line 11.

There is a water level sensor 21 at one side of an upper part of the case 1 for sensing a water level of the inner tub 3 and providing to the controlling part (not shown). There is an air tube 22 connected between the water level sensor 21 and the outer tub 2 for sensing water level of the inner tub 3 by using an air pressure transmitted through the air tube 22.

A method for controlling washing in accordance with a first preferred embodiment of the present invention will be explained with reference both to the foregoing washing machine and FIGS. 3–5. An ordinate in FIG. 5 represents a washing time period and an abscissa in FIG. 5 represents a rotation speed of the inner tub 3.

Figure 3:
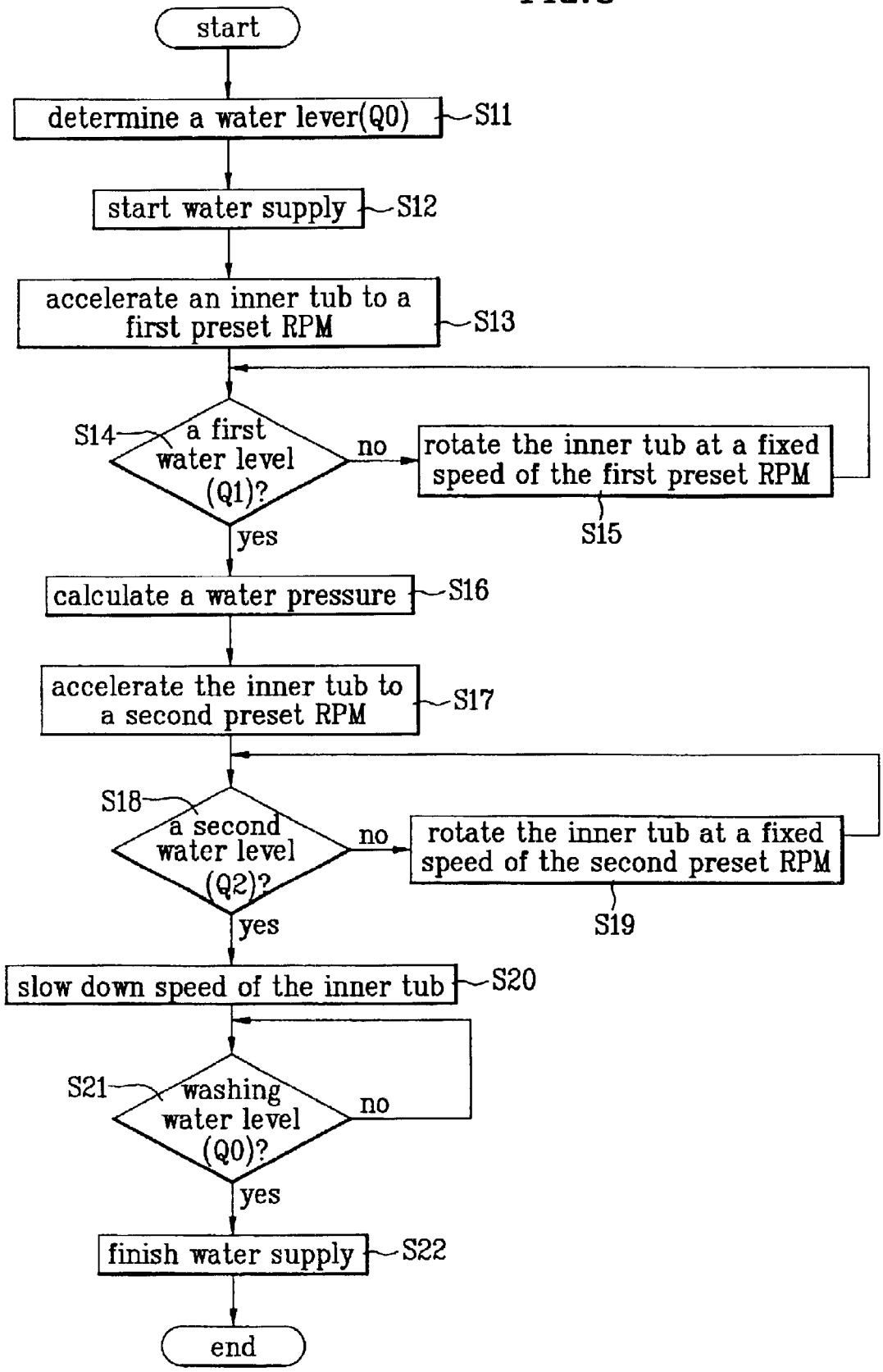
FIG. 3 illustrates a flow chart showing the steps of a method for controlling washing in accordance with a first preferred embodiment of the present invention.
Figure 4:
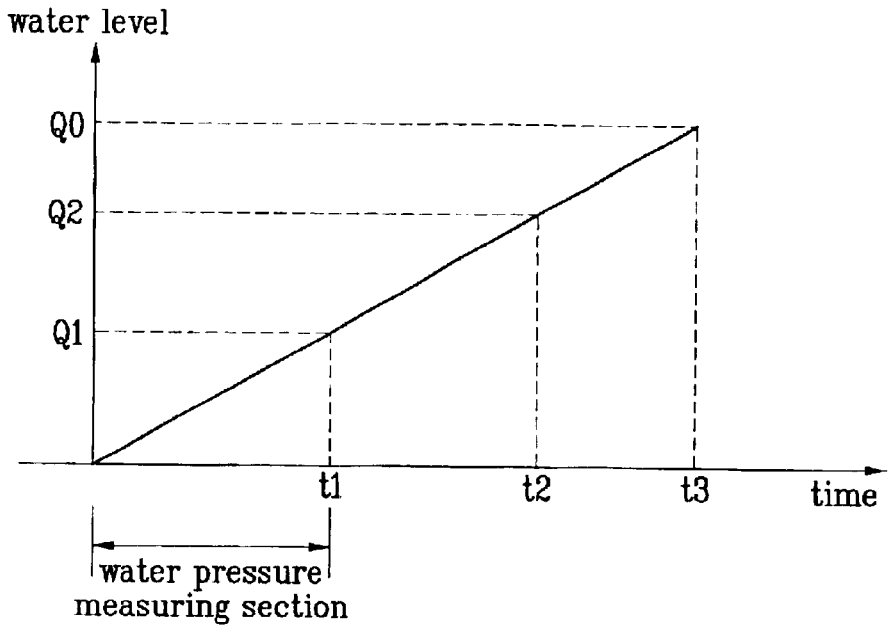
FIG. 4 illustrates a graph showing a water supply time period vs. an amount of washing water in a method for controlling washing of the present invention.
Figure 5:
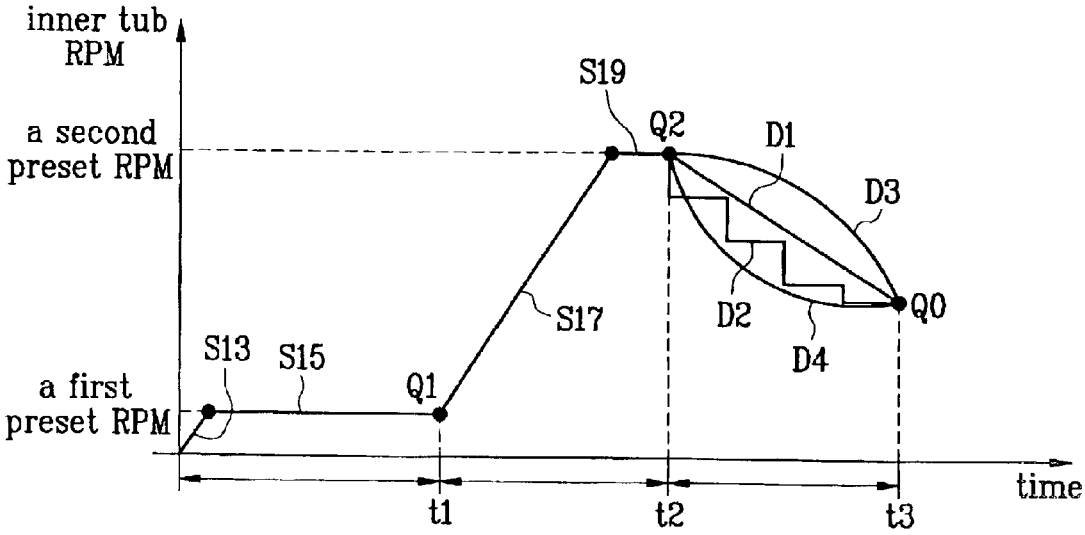
FIG. 5 illustrates a graph showing a water supply time period vs. a rotation speed of an inner tub in a method for controlling washing in accordance with a first preferred embodiment of the present invention.

Referring to FIGS. 3–5, in the method for controlling washing in accordance with a first preferred embodiment of the present invention, at first, the controlling part senses an amount of laundry in the inner tub 3, and determines a washing water level Q0 proper to the laundry amount (S11). The controlling part senses the amount of laundry either by using a separate weight sensor fitted to the inner tub 3 or outer tub 2, or by sensing a load on the driving part 4 when the inner tub 3 is reversed.

Next, the controlling part opens the water supply valve 12 to supply washing water 3 into the inner tub 3.

Then, during the water supply, the controlling part applies a signal to the driving part 4 to rotate the inner tub 3 in one direction. This process is similar to a general centrifugal washing process. That is, if the inner tub 3 is rotated at a speed higher than a preset level, the washing water in the inner tub rises along a space between the inner tub 3 and the outer tub 2, and sprayed into the inner tub again by a cover 2*a* on top of the outer tub. Through this process, the detergent introduced into the inner tub 3 is dissolved more quickly, leading to spray a high concentration of detergent solution onto the laundry, directly.

In the meantime, as the water supply is progressed, the water level of the inner tub 3 keeps rising, to require a proper regulation of the rotation speed of the inner tub, too. Otherwise, the washing water in the inner tub 3 can be splashed to the outer tub 2.

This process will be explained in detail. At first, when water supply is started, the controlling part accelerates the inner tub 3 up to a first preset RPM (S13). This process is continued until the water level of the inner tub 3 reaches to the preset first water level Q1. In this instance, at the first RPM, though the washing water has a centrifugal force applied thereto, the washing water is not splashed over a top part of the inner tub 3, but rotates in the inner tub or the outer tub 2, to dissolve the detergent, uniformly.

Then, the controlling part determines the present water level in the inner tub 3 is reached to the first water level Q2 (S14). The present water level in the inner tub 3 is sensed as the controlling part receives a signal from the water level sensor 21.

In general, a time period required for the inner tube 3 to reach to the preset RPM is shorter than a time period required for the water level to reach to the preset water level. Therefore, if the present water level of the inner tub 3 is not reached to the first water level Q1, the controlling part rotates the inner tub at a fixed speed of the first RPM (S15).

Next, when the present water level of the inner tub 3 reaches to the first water level Q1, the controlling part applies a signal to the driving part 4, to increase the rotation speed of the inner tub 3 up to a preset second RPM (S17). This process is progressed until the water level of the inner tub 3 reaches to a preset second water level Q2. The second RPM is a rotation speed in which the washing water rises in a space between the inner tub 3 and the outer tub 2 by a centrifugal force, and splashed into the inner tub again. The second water level Q2 is the highest water level at which the washing water is not splashed to outside of the outer tub 2 when the inner tub 3 rotates at the second RPM.

Then, the controlling part determines if the present water level of the inner tub 3 reaches to the second water level Q2 (S18). In this instance, the controlling part can not sense the present water level of the inner tub 3 by the water level sensor 21, because the motion of the water level is active in a state the inner tub 3 rotates at the second RPM by a centrifugal force, when an exact detection of the present water level of the inner tub 3 by using the water level sensor 21 that uses an air pressure is impossible.

In order to solve the foregoing problem, it is preferable that a process (S18) is carried out, in which the controlling part calculates the present water pressure by using a time period t1 required for the water level of the inner tub 3 to reach to the first water level Q1. That is, referring to FIG. 4, it is natural that the water level of the inner tub 3 rises in proportion to a water pressure of the washing water. Therefore, the controlling part can calculate the time period the water level in the inner tub 3 reaches to the second water level Q2 from the first water level Q1 by using the water pressure of the washing water based on preset first water level Q1 and second water level Q2. In this instance, the controlling part determines that the present water level of the inner tub 3 is reached to the second water level Q2 automatically when a time t2 comes at which the water level of the inner tub 3 reaches to the second water level Q2.

As a result of the determination, if the present water level of the inner tub 3 is not reached to the second water level Q2, the controlling part rotates the inner tub at a fixed speed of the second RPM (S19), under a reason explained before.

As a result of the determination, if the present water level of the inner tub 3 is reached to the second water level Q2, the controlling part applies a signal to the driving part 4 to slow down the speed of the inner tub 3 (S20), for avoiding splash of the washing water out of the outer tub 2.

Then, the controlling part determines if the present water level of the inner tub 3 is reached to an initially set washing water level Q0 (S21), and, if reached, the water supply valve 12 is cut off, to stop the water supply (S22).

It is preferable that a speed slow down pattern of the inner tub 3 is determined according to the water pressure calculated before, and the present invention suggests the following speed slow down pattern of the inner tub with reference to FIG. 5.

First, the speed of the inner tub 3 may be slowed down linearly along a straight line D1 of a fixed slope until the water supply is finished. This process is applicable when the present water pressure is a general average water pressure. The linear slow down of the inner tub 3 can reduce a load on the driving part 4.

Second, the inner tub 3 may be slowed down step by step by repeating a reduced speed rotation and a fixed speed rotation until the water supply is finished (D2). This process, applicable when the present water pressure is a general average water pressure, can improve the pre-washing efficiency by enhancing solubility of the detergent, though the process may be put a slightly excessive load on the driving part 4.

Third, the speed of the inner tub 3 may be slowed down along a curve D3 and D4 of a fixed curvature non-linearly until the water supply is finished. This process is applicable when the present water pressure is higher or lower than an average water pressure. That is, when the present water pressure is higher than an average water pressure, it is preferable that the speed of the inner tub 3 is slowed down along a concave curve D4 since it is highly possible that the washing water splashes out of the outer tub 2. Opposite to this, when the present water pressure is higher than the average water pressure, it is preferable that the speed of the inner tub 3 is slowed down along a convex curve D3 slowly since the possibility of the washing water splash is low.

A method for controlling washing in a washing machine in accordance with a second preferred embodiment of the present invention will be explained, with reference to FIGS. 6A–7. An abscissa in FIG. 7 represents a washing time period, and an ordinate in FIG. 7 represents a rotation speed of the inner tub 3. The method for controlling washing in a washing machine in accordance with a second preferred embodiment of the present invention progresses following steps identical to the first embodiment method up to a certain extent.

Figure 6A:
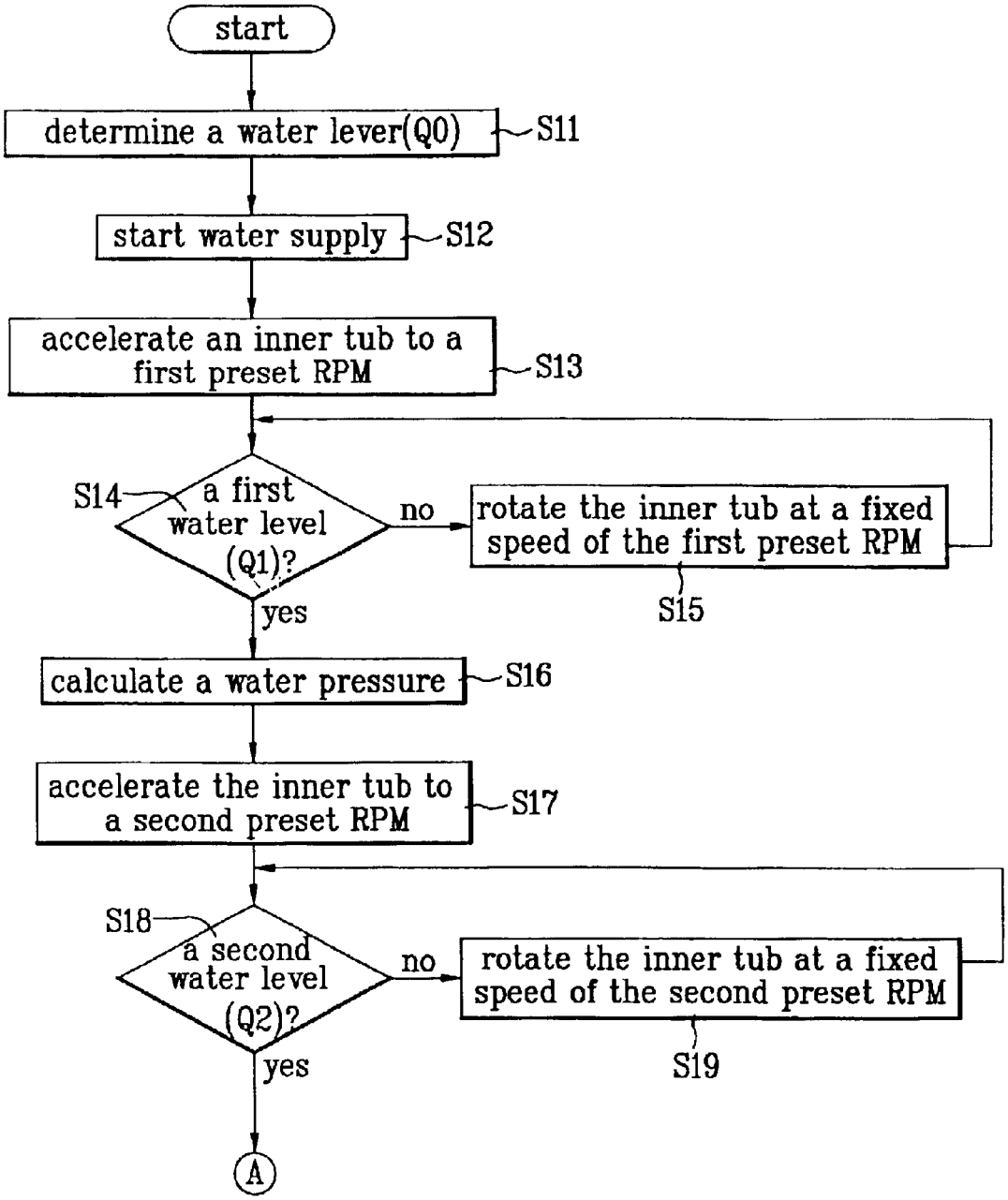
FIGS. 6A and 6B illustrate flow charts showing the steps of a method for controlling washing in accordance with a second preferred embodiment of the present invention.
Figure 6B:
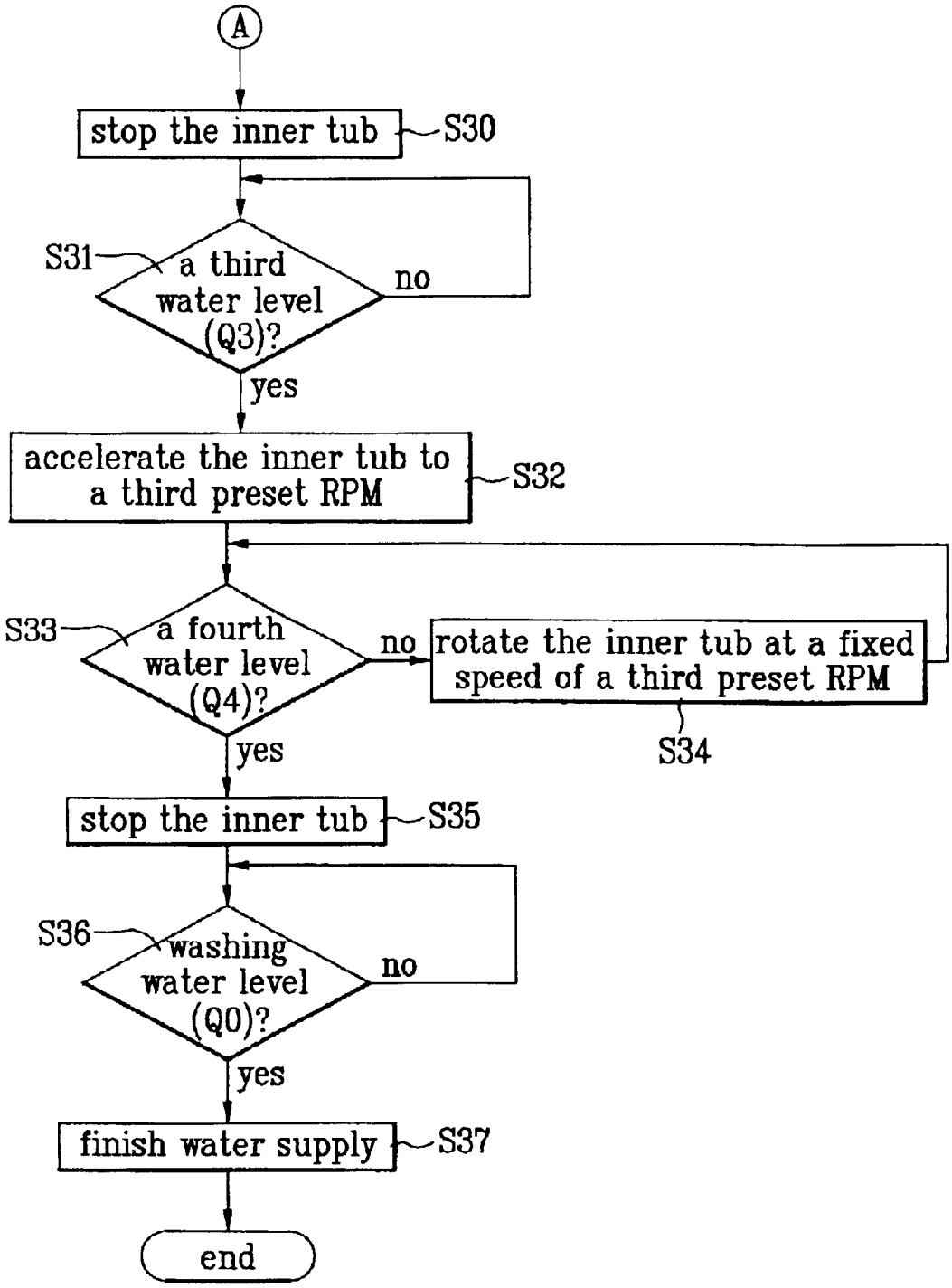
Figure 7:
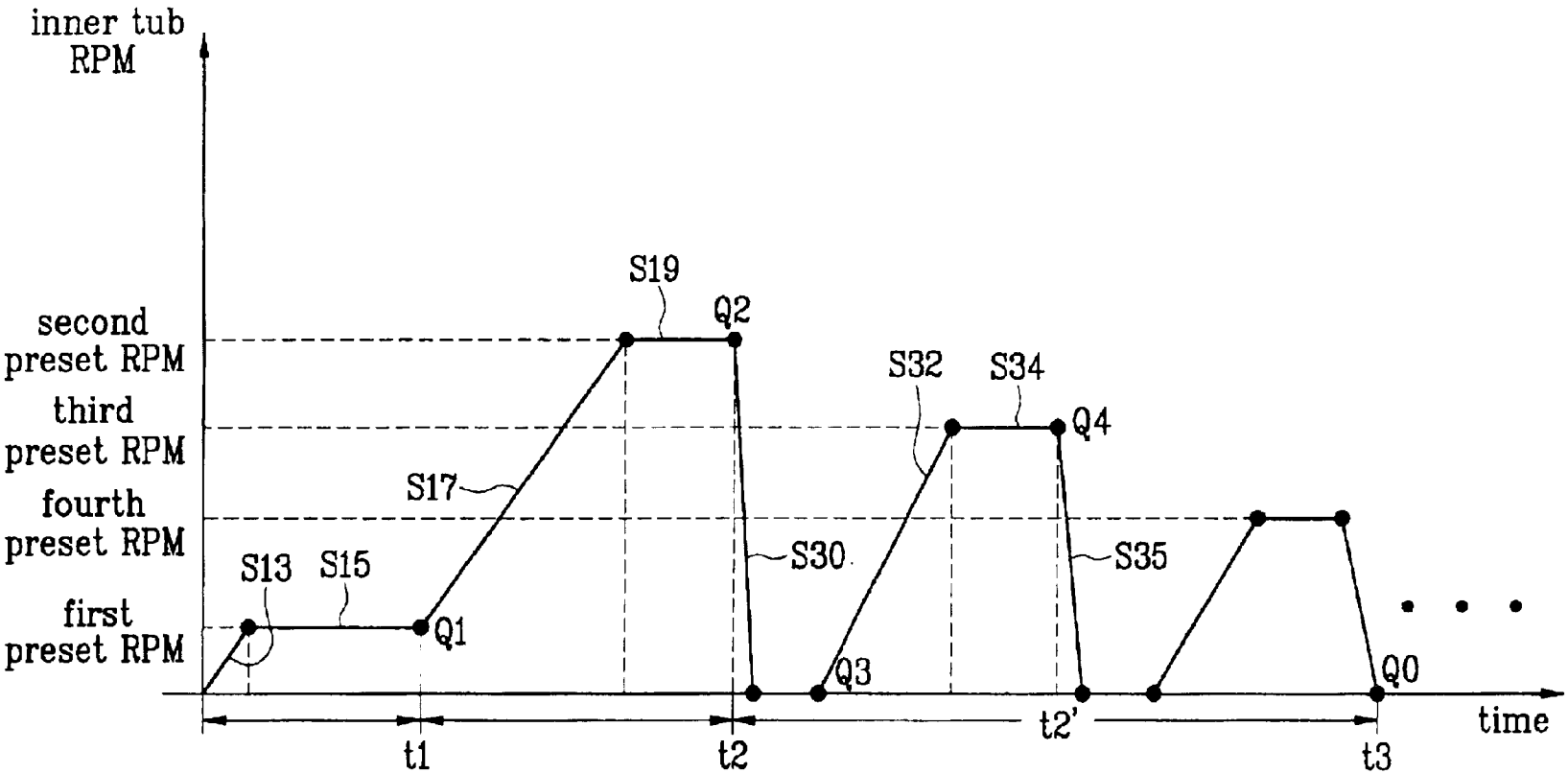
FIG. 7 illustrates a graph showing a water supply time period vs. a rotation speed of an inner tub in a method for controlling washing in accordance with a second preferred embodiment of the present invention.

Referring to FIGS. 6A–7, at first, the controlling part senses an amount of laundry in the inner tub 3, and determines a washing water level Q0 proper to the amount of the laundry (S11). Then, the controlling part opens the water supply valve 12, for supplying washing water to the inner tub 3 (S12).

When the water supply starts, the controlling part accelerates the inner tub 3 up to a first RPM (S13). This process is continued until the water level of the inner tub 3 reaches to a preset first water level Q1. In this instance, the washing water in the inner tub 3 does not splash over top of the inner tub, but circulates inside of the inner tub or the outer tub 2, and dissolves the detergent, uniformly.

Then, the controlling part determines if the present water level of the inner tub 3 is reached to the first water level Q1 (S14). If the present water level of the inner tub 3 is not reached to the first water level Q1, the controlling part rotates the inner tub 3 at a fixed speed (S15).

Next, when the present water level of the inner tub 3 is reached to the first water level Q1, the controlling part applies a signal to the driving part 4, to increase a rotation speed of the inner tub to a preset second RPM (S17). This process is progressed until the water level of the inner tub 3 is reached to the preset second water level Q2. The second RPM is a rotation speed at which the washing water rises in a space between the inner tub 3 and the outer tub 2 from the first water level Q1 by a centrifugal force, and is splashed into the inner tub, again. The second water level Q2 is the highest water level at which the washing water does not splash to the outer tub 2 when the inner tub 3 rotates at the second RPM.

Next, the controlling part determines if the present water level of the inner tub 3 is reached to the second water level Q2 (S18). Meanwhile, the controlling part calculates the present water pressure by using a time period t1 required for the water level of the inner tub 3 to reach to the first water level Q1 in advance (S16), using which a time period required for the water level of the inner tub 3 to reach to the second water level Q2 from the first water level Q1 is calculated. In this instance, the controlling part determines that the present water level of the inner tub 3 is reached to the second water level Q2 automatically when a time t2 comes at which the water level of the inner tub 3 is reached to the second water level Q2.

As a result of the determination, if the present water level of the inner tub 3 is not reached to the second water level Q2, the controlling part rotates the inner tub at a fixed speed of the second RPM (S19).

As a result of the determination, if the present water level of the inner tub 3 is reached to the second water level Q2, the controlling part applies a signal to the driving part 4 to stop the inner tub 3 (S30), for settling the washing water that is turbulent between the inner tub 3 and the outer tub 2.

Then, the controlling part determines if the present water level of the inner tub 3 is reached to a third washing water level Q3 (S31). The present water level of the inner tub 3 is sensed through the water level sensor 21.

When the present water level of the inner tub 3 is reached to the preset third water level Q3, the controlling part applies a signal to the driving part 4 to accelerate the inner tub 3 to the preset third RPM (S32). The process is progressed until the water level of the inner tub 3 is reached to a preset fourth water level Q4. In this instance, the third RPM is a rotation speed at which, after the washing water rises in a space between the inner tub 3 and the outer tub 2 from the third water level Q3 by a centrifugal force, the washing water is splashed into the inner tub again. As the third water level Q3 is higher than the second water level Q2, it is certain that the third RPM is smaller than the second RPM. The fourth water level Q4 is the highest water level at which the washing water does not splash to the outer tub 2 when the inner tub 3 rotates at the third RPM.

Next, the controlling part determines if the present water level of the inner tub 3 is reached to the fourth water level Q4 (S33). In this instance, the controlling part calculates a time period required for the water level of the inner tub 3 to reach to the fourth water level Q4 by using the present water pressure calculated before. Accordingly, the controlling part automatically determines that the present water level of the inner tub 3 is reached to the fourth water level Q4 when a time t2' comes at which the water level of the inner tub 3 is reached to the fourth water level Q4.

As a result of the determination, if the present water level of the inner tub 3 is not reached to the fourth water level Q4, the controlling part rotates the inner tub at a fixed speed of the third RPM (S34).

As a result of the determination, if the present water level of the inner tub 3 is reached to the fourth water level Q4, the controlling part applies a signal to the driving part 4 to stop the inner tub 3 (S35), for preventing the washing water from splashing to a part outside of the outer tub 2.

Then, the controlling part determines if the present water level of the inner tub 3 is reached to an initially set washing water level Q0 (S36). As a result, if the water level of the inner tub 3 is reached to the washing level Q0, the water supply valve 12 is closed, to stop the water supply (S37).

The foregoing process, i.e., at first, the inner tub is stopped until the water level of the inner tub 3 is reached to the second water level Q2, the inner tub is rotated until the water level of the inner tub is reached to the fourth water level Q4 from the third water level Q3, and the inner tub is stopped, is provided for improving a pre-washing efficiency by washing water spray. That is, the water level of the inner tub 3 increases in proportion to the water pressure as the time passes. In this instance, by rotating the inner tub 3 within a range in which no splash occurs appropriately, the washing water can be sprayed by the centrifugal force until a time point the water supply is finished.

In this point of view, it is preferable that the foregoing steps S30–S35 are selectively repeated until the water supply is finished while slowing down a rotation speed of the inner tub 3. That is, until the water level of the inner tub 3 is reached to a water level higher than the fourth water level Q4, a process may be repeated as many as required, in which the inner tub 3 is stopped after being rotated at a RPM lower than the third RPM.

As has been explained, the present invention provides a method for controlling washing in a washing machine, in which a pre-washing is implemented during water supply even if no separate re-circulating device is provided. Accordingly, the present invention provides advantages of improving a washing performance and shortening a washing time period by dissolving more detergent quickly during water supply. Moreover, the present invention can solve the problem of washing water contamination by detergent, not dissolved, but remained in the washing water in the washing process.

It will be apparent to those skilled in the art that various modifications and variations can be made in the method for controlling washing in a washing machine of the present invention without departing from the spirit or scope of the invention. Thus, it is intended that the present invention cover the modifications and variations of this invention provided they come within the scope of the appended claims and their equivalents.

What is claimed is:

1. A method for controlling washing in a washing machine, comprising the steps of:

(a) sensing an amount of laundry in an inner tub and determining a washing water level proper to the amount of laundry;

(b) introducing washing water into the inner tub according to the washing water level; and (c) rotating the inner tub in one direction so that the washing water rises along a space between the inner tub and an outer tub and is sprayed into the inner tub again by a centrifugal force during the step (b).

2. A method as claimed in claim 1, wherein the step (c) includes the steps of;

(c1) accelerating the inner tub to a preset first RPM, while the washing water is supplied to a preset first water level, (c2) calculating the present water pressure by using a time period the water is supplied to the first water level, (c3) when the water level of the inner tub is reached to the first water level, increasing a rotation speed of the inner tub up to a preset second RPM until the water level of the inner tub is reached to a preset second water level, for spraying the washing water into the inner tub by the centrifugal force, and (c4) when the water level in the inner tub is reached to the second water level, reducing the rotation speed of the inner tub for preventing the washing water from being splashed to a part outside of the outer tub.

3. A method as claimed in claim 2, wherein the step (c1) further includes the step of rotating the inner tub at a fixed speed of a first RPM when the water level of the inner tub is not reached to the first water level after the inner tub is accelerated to the first RPM.

4. A method as claimed in claim 2, wherein the step (c3) further includes the step of rotating the inner tub at a fixed speed of a second RPM if the water level of the inner tub is not reached to the second water level after the inner tub is accelerated to the second RPM.

5. A method as claimed in claim 2, wherein the step (c4) includes the step of determining speed slow down patterns of the inner tub according to a water pressure in the (c2) step.

6. A method as claimed in claim 5, wherein the speed slow down pattern is a straight line with a fixed slope until the water supply to the inner tub is finished.

7. A method as claimed in claim 5, wherein the speed slow down pattern is a step by step speed slow down in which a reduced speed rotation and a fixed speed rotation are repeated continuously until the water supply to the inner tub is finished.

8. A method as claimed in claim 5, wherein the speed slow down pattern is a non-linear curve of a fixed curvature until the water supply to the inner tub is finished.

9. A method as claimed in claim 2, wherein the step (c3) includes the step of checking by a water level sensor if the water level of the inner tub is reached to the first water level.

10. A method as claimed in claim 2, wherein the step (c4) includes the step of checking through the water pressure in the step (c2) if the water level of the inner tub is reached to the second water level.

11. A method for controlling washing in a washing machine, comprising the steps of:

(a) sensing an amount of laundry in an inner tub and determining a washing water level proper to the amount of laundry;

(b) introducing washing water into the inner tub according to the washing water level;

(c) accelerating the inner tub to a preset first RPM, while the washing water is supplied to a preset first water level;

(d) calculating the present water pressure by using a time period the water is supplied to the first water level;

(e) when the water level of the inner tub is reached to the first water level, increasing a rotation speed of the inner tub up to a preset second RPM until the water level of the inner tub is reached to a preset second water level, for spraying the washing water into the inner tub by the centrifugal force;

(f) when the water level in the inner tub is reached to the second water level, stopping rotation of the inner tub to settle the washing water;

(g) when the water level of the inner tub is reached to a third water level, increasing the rotation speed of the inner tub up to a preset third RPM until the water level of the inner tub is reached to a preset fourth water level, for spraying the washing water into the inner tub by the centrifugal force; and (h) when the water level in the inner tub is reached to the fourth water level, stopping rotation of the inner tub for preventing the washing water from splashing to outside of the outer tub.

12. A method as claimed in claim 11, wherein the third RPM is lower than the second RPM in the step (g).

13. A method as claimed in claim 11, wherein the step (g) further includes the step of rotating the inner tub at a fixed speed of the third RPM when the water level of the inner tub is not reached to the fourth water level after the inner tub is accelerated to the third RPM.

14. A method as claimed in claim 11, wherein the steps (f), (g), and (h) are selectively repeated while the rotation speed of the inner tub is slowed down until the water supply is finished.

* * * * *